US005162850A

United States Patent [19]

Nakashima

[11] Patent Number: 5,162,850

[45] Date of Patent: Nov. 10, 1992

[54] IMAGE FORMING APPARATUS USING A LINEAR EQUATION TO SENSE SURFACE POTENTIAL

[75] Inventor: Yoshihiro Nakashima, Tokyo, Japan

[73] Assignee: Ricoh Company, Ltd., Tokyo, Japan

[21] Appl. No.: 733,888

[22] Filed: Jul. 22, 1991

[30] Foreign Application Priority Data

Jul. 23, 1990 [JP] Japan ..... 2-194376

[51] Int. Cl.[5] ..... G03G 21/00; G03G 15/02

[52] U.S. Cl. ..... 355/208; 355/214; 355/246

[58] Field of Search ..... 355/208, 214, 246

[56] References Cited

U.S. PATENT DOCUMENTS

| | | | |
|---|---|---|---|
| 3,788,739 | 1/1974 | Coriale | 355/246 X |
| 4,026,643 | 5/1977 | Bergman | 355/246 |
| 4,129,375 | 12/1978 | Miyakawa et al. | 355/246 |
| 4,178,095 | 12/1979 | Champion et al. | 355/246 X |
| 4,583,839 | 4/1986 | Suzuki | 355/246 |
| 4,853,738 | 8/1989 | Rushing | 355/246 X |
| 4,949,135 | 8/1990 | Ng | 355/246 X |

FOREIGN PATENT DOCUMENTS

| | | |
|---|---|---|
| 63-172261 | 7/1988 | Japan . |
| 01-225284 | 9/1989 | Japan . |
| 2140330 | 11/1984 | United Kingdom . |

*Primary Examiner*—Fred L. Braun

*Attorney, Agent, or Firm*—Oblon, Spivak, McClelland, Maier & Neustadt

[57] ABSTRACT

An image forming apparatus for uniformly charging the surface of a photoconductive element, exposing the charged surface of the photoconductive element imagewise to electrostatically form a latent image, and developing the latent image by a toner or similar developer. A linear equation is produced which is a reference representative of the input-output characteristic of a sensor responsive to the surface potential of the photoconductive element. The linear equation is used to calculate an accurate surface potential matching the output of the sensor. A bias voltage for development or similar image forming condition is controlled on the basis of the calculated surface potential.

8 Claims, 8 Drawing Sheets

SENSOR CALIBRATION
POWER ON
1
SET FLAG F "0"
2
3
PHOTOCONDUCTIVE SURFACE 0 POTENTIAL ?
NO
YES
ZERO POTENTIAL
4
APPLY 100V
5

IMAGE FORMING APPARATUS USING A LINEAR EQUATION TO SENSE SURFACE POTENTIAL

BACKGROUND OF THE INVENTION

The present invention relates to an image forming apparatus of the type uniformly charging a photoconductive element, exposing the charged surface of the photoconductive element imagewise to electrostatically form a latent image thereon, and developing the latent image by a toner or similar developer. More particularly, the present invention is concerned with an image forming apparatus which senses the surface potential of the photoconductive element by a sensor and controls an image forming condition or conditions on the basis of the sensed surface potential.

A copier, laser printer and facsimile transceiver belong to a family of image forming apparatuses of the type described. With a copier, for example, it is a common practice to illuminate the charged surface of a photoconductive element by light representative of a document image. To enhance the quality of a reproduced image, the copier senses the surface potential of the photoconductive element by a non-contact type sensor and controls the bias for development or similar image forming parameter in matching relation to the sensed surface potential. The problem with such a copier is that the distance between the sensor and the surface of the photoconductive element and, therefore, the output of the sensor is not constant due to mechanical irregularities. Should the image forming parameter be controlled on the basis of such an output of the sensor, the resultant image would suffer from the deviation in notch.

In light of the above, a non-contact type sensor having a distance compensating circuit has been proposed in the past. However, even the distance compensating circuit is not fully free from the influence of the irregularity in the distance between the sensor and the photoconductive element. In addition, an image forming apparatus with such an extra circuit would be expensive.

To promote the accurate measurement of a surface potential, a particular reference potential area may be provided on the surface of the photoconductive element, as disclosed in Japanese Patent Laid-Open Publication No. 55356/1980. The surface potential of the reference potential area is sensed by a non-contact type potential sensor, while the potential of the other area is sensed by another non-contact type potential sensor. Then, the surface potential of the photoconductive element is determined on the basis of the result of differential amplification of the sensed two surface potentials. This approach, however, brings about another problem that part of the surface of the photoconductive element is occupied by the reference potential area and cannot join in the image forming operation at all, i.e., the surface of the element cannot be effectively used.

SUMMARY OF THE INVENTION

It is therefore an object of the present invention to provide an image forming apparatus capable of accurately measuring the surface potential of a photoconductive element without being effected by the irregularity in the distance between a non-contact type potential sensor and the surface of the photoconductive element.

It is another object of the present invention to provide a generally improved image forming apparatus with a photoconductive element.

An image forming apparatus for uniformly charging the surface of a photoconductive element, exposing the charged surface of the photoconductive element imagewise to electrostatically form a latent image, and developing the latent image of the present invention comprises a potential sensor for sensing the surface potential of the photoconductive element to produce an output signal representative of the sensed surface potential, and a controller responsive to the output signal of the potential sensor for controlling an image forming condition of the apparatus such that a surface potential corresponding to the output signal of the potential sensor is calculated on the basis of a linear equation which is a reference representative of the input-output characteristic of the potential sensor.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, a brief reference will be made to a conventional image forming apparatus of the type to which the present invention pertains. With an image forming apparatus, it has been customary to sense the surface potential of a photoconductive element by a non-contact type sensor and to adjust the bias voltage for development or similar parameter on the basis of the sensed surface potential, thereby enhancing the image quality. The problem with this implementation is that the distance between the sensor and the surface of the photoconductive element and, therefore, the output of the sensor changes due to mechanical irregularities, as discussed earlier.

Figure 7:
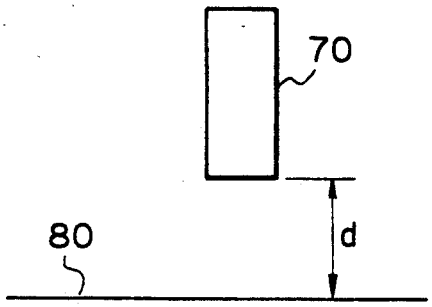
FIG. 7 is an enlarged side elevation showing a distance or gap between the surface of a photoconductive element and a non-contact type potential sensor.
Figure 8:
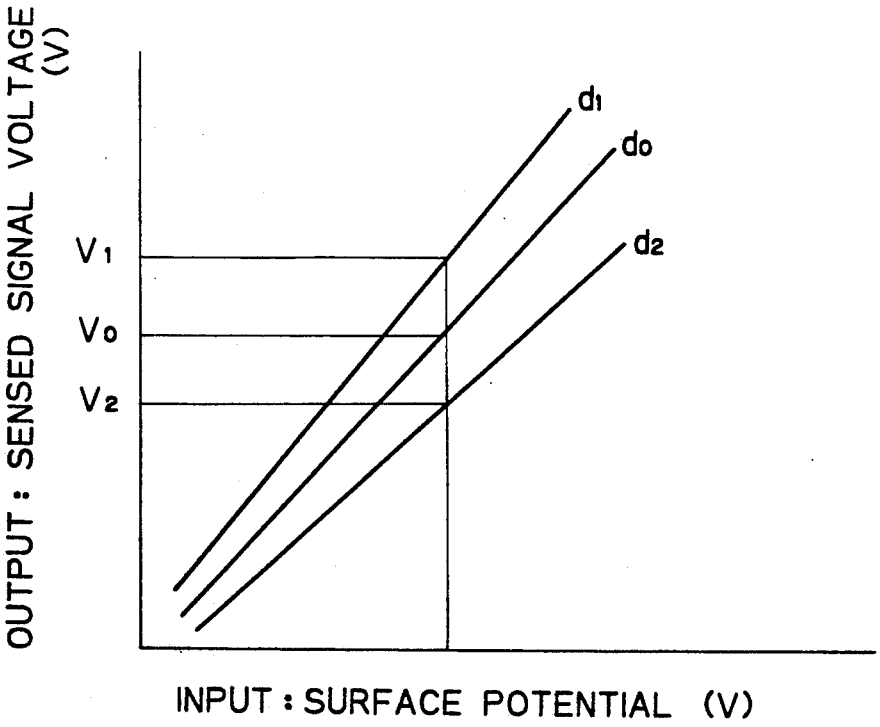
Fig. 8 PRIOR ART
FIG. 8 is a graph indicative of a relation of the input-output characteristic of a non-contact type potential sensor to the distance or gap shown in FIG. 7.

Specifically, FIGS. 7 and 8 show respectively a relation between the distance or gap d between the non-contact type sensor, 70, and the surface of the photoconductive element, 80, and a relation between the input and output of the sensor 70. The input and output of the sensor 70 are respectively the surface potential of the photoconductive element 80 and the corresponding signal voltage. For example, even when the sensor 70 and the photoconductive element 80 are so positioned as to define a gap $d_0$ therebetween, the actual gap is $d_1$ or $d_2$ due to mechanical irregularities. As a result, the voltage $V_1$ or $V_2$ corresponding to the gap $d_1$ or $d_2$ is deviated from the voltage $V_0$ corresponding to the designed gap $d_0$. Assume that the difference between the voltages $V_0$ and $V_1$ is great, e.g., $|V_0-V_1|/V_0$ is 0.1. Then, despite that the actual surface potential of the photoconductive element 80 is 800 volts, 880 volts will be sensed when the gap is $d_1$. If a bias voltage matching the surface potential of 880 volts is applied, an image with a deviation in notch will be reproduced.

While various implementations such as a sensor with a distance compensating circuit and a special measuring device have been proposed, as previously described, none of them is fully satisfactory.

Figure 1:
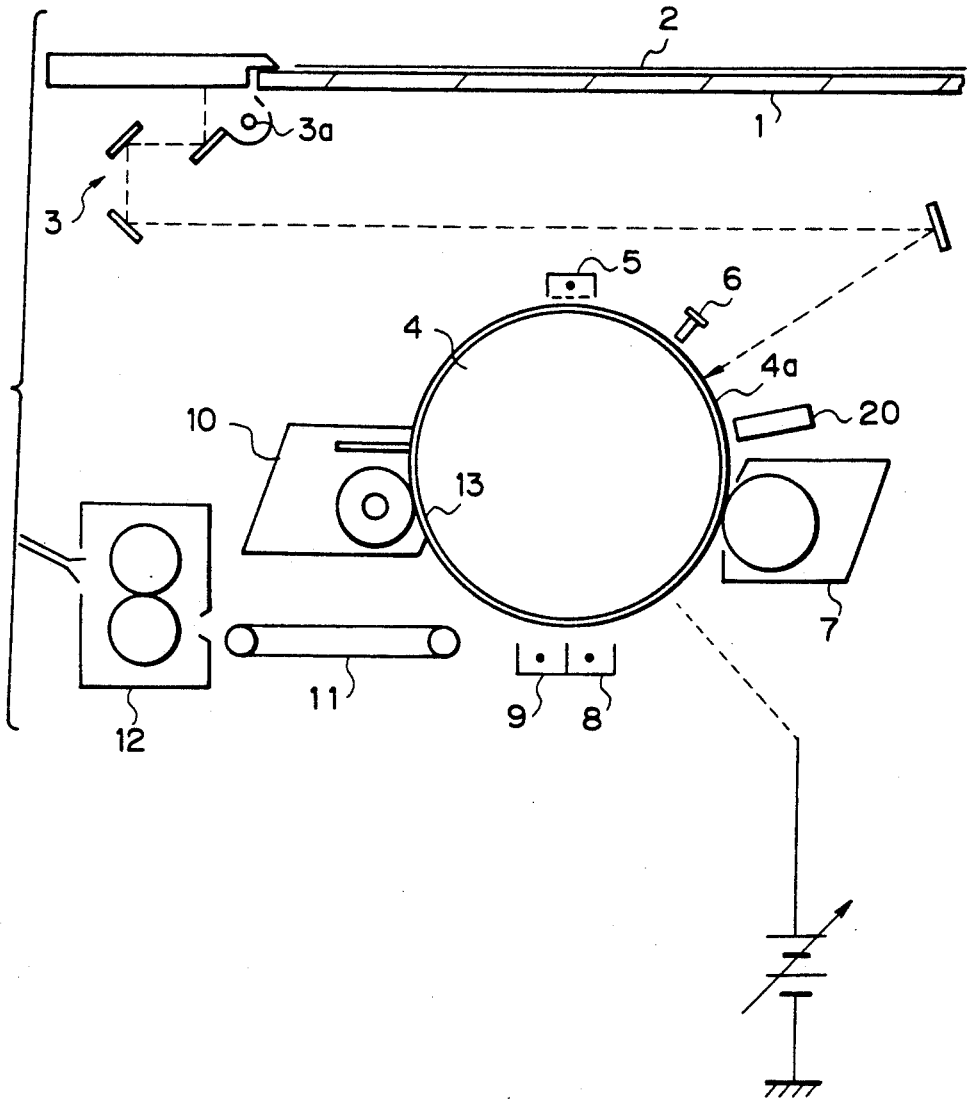
FIG. 1 is a block diagram schematically showing an image forming apparatus embodying the present invention and implemented as a copier.

Referring to FIG. 1, an image forming apparatus embodying the present invention is shown and implemented as a copier by way of example. As shown, the copier has a glass platen 1 on which a document 2 is laid. Optics 3 includes a lamp 3*a* and a plurality of mirrors and scans the document 2 in synchronism with the rotation of a photoconductive element 4. The surface of the photoconductive element 4 has been uniformly charged to a predetermined high potential by a main charger 5. While the lamp 3*a* illuminates the document 2, the resultant a reflection from the document 2 is incident onto the charged surface 4*a* of the photoconductive element 4 to electrostatically form a latent image thereon. At this instant, the charged surface of the photoconductive element 4 has been discharged by an eraser 6 except for an image forming area thereof. A developing unit 7 develops the latent image by a toner to produce a toner image. A transfer charger 8 transfers the toner image to a recording medium in the form of a sheet, not shown, which has been fed from a sheet feed section, not shown, in such a manner as to meet the surface 4*a* of the photoconductive element 4 at a predetermined timing. A separation charger 9 separates the recording sheet with the toner image from the photoconductive element 4. Thereafter, a cleaner 10 removes the toner remaining on the surface 4*a* of the photoconductive element 4. On the other hand, the recording sheet is transported by a belt 11 to a fixing unit 12. The fixing unit 12 fixes the toner image on the recording sheet by heat. Then, the recording sheet is driven out of the copier via a sheet discharge arrangement, not shown.

In the illustrative embodiment, a non-contact type potential sensor 20 is located at a position immediately preceding the developing unit 7. Such a position of the sensor 20 provides a sufficient margin regarding the response time of the photoconductive element 4, i.e., the sensor 20 is sufficiently spaced apart from the position where the element 4 is to be exposed imagewise. A heater 13 is accommodated in the photoconductive element 4 for heating the element 4. A temperature sensor or thermistor, not shown, for controlling the temperature of the photoconductive element 4 is juxtaposed to the potential sensor 20 in the direction perpendicular to the sheet surface of FIG. 1 in order to effectively use the limited space around the element 4. The thermistor is held in contact with the photoconductive element 4 except when the photoconductive element 4 is to be replaced. While the potential sensor 20 senses the surface potential of the photoconductive element 4, the bias voltage for development is controlled on the basis of the sensed surface potential.

Figure 2:
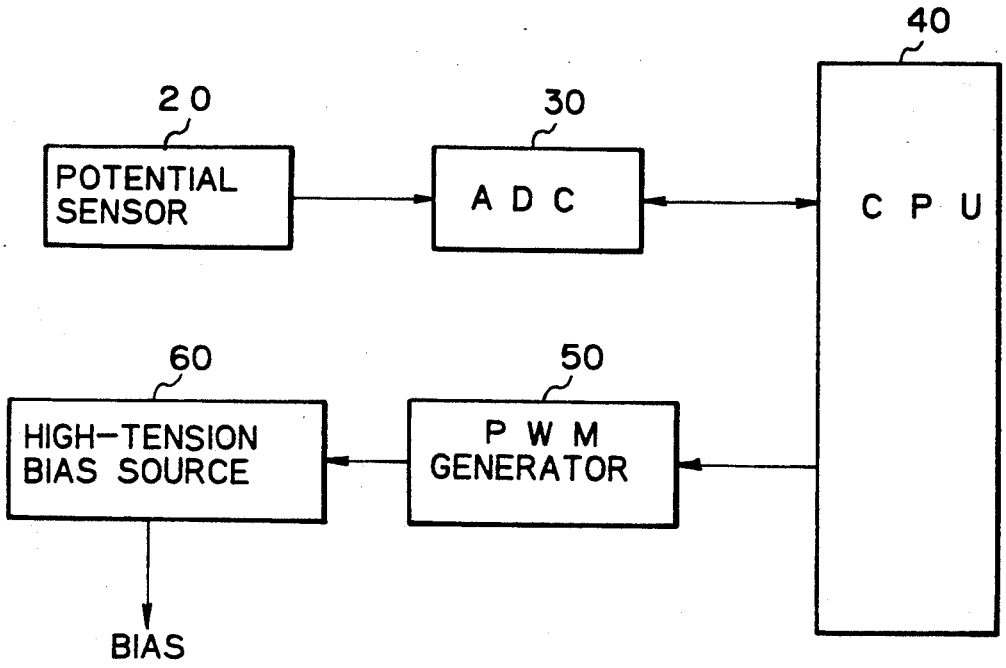
FIG. 2 is a block diagram schematically showing part of a bias control system included in the embodiment.

FIG. 2 shows circuitry for controlling the bias voltage to be applied to the developing unit 7, FIG. 1. As shown, an analog-to-digital converter (ADC) 30 converts the analog output of the potential sensor 20 to a digital signal. Reading the digital output of the potential sensor 20, a microcomputer or CPU 40 determines the accurate surface potential of the photoconductive element 4 by a procedure which will be described. The surface potential so determined by the CPU 40 is fed back to the bias voltage for development. Hence, even when the characteristics of the photoconductive element 4 change due to aging, for example, it is possible to prevent the quality of a recorded image from degrading. In the embodiment, a PWM (Pulse Width Modulation) generator 50 generates a PWM signal waveform to thereby determine the bias voltage to be generated by a high-tension power source or bias source 60.

Figure 3:
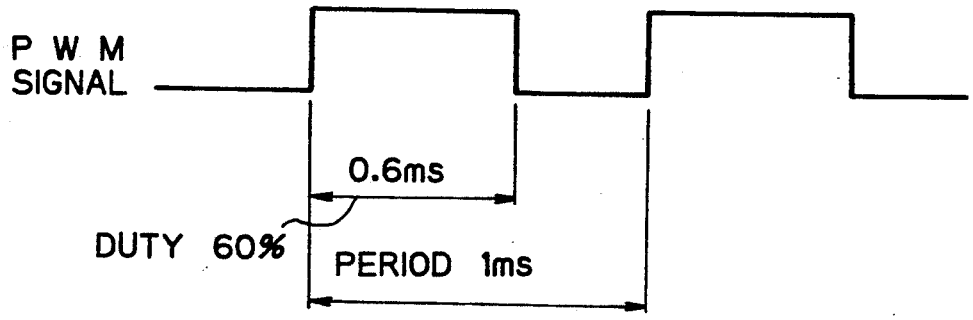
FIG. 3 is a timing chart showing a specific PWM (Pulse Width Modulation) signal waveform to be generated by a PWM generator shown in FIG. 2.

A specific PWM signal waveform which the PWM generator 50 generates is shown in FIG. 3. The PWM signal waveform shown in the figure has a period of 1 millisecond and a pulse width of 0.6 millisecond (duty of 60%). A bias voltage of 600 volts is associated with the pulse width of 0.6 millisecond. Then, a bias voltage of 100 volts is obtainable if the pulse width is reduced to 0.1 millisecond while a bias voltage of 800 volts is obtainable if the pulse width is increased to 0.8 millisecond.

Figure 4:
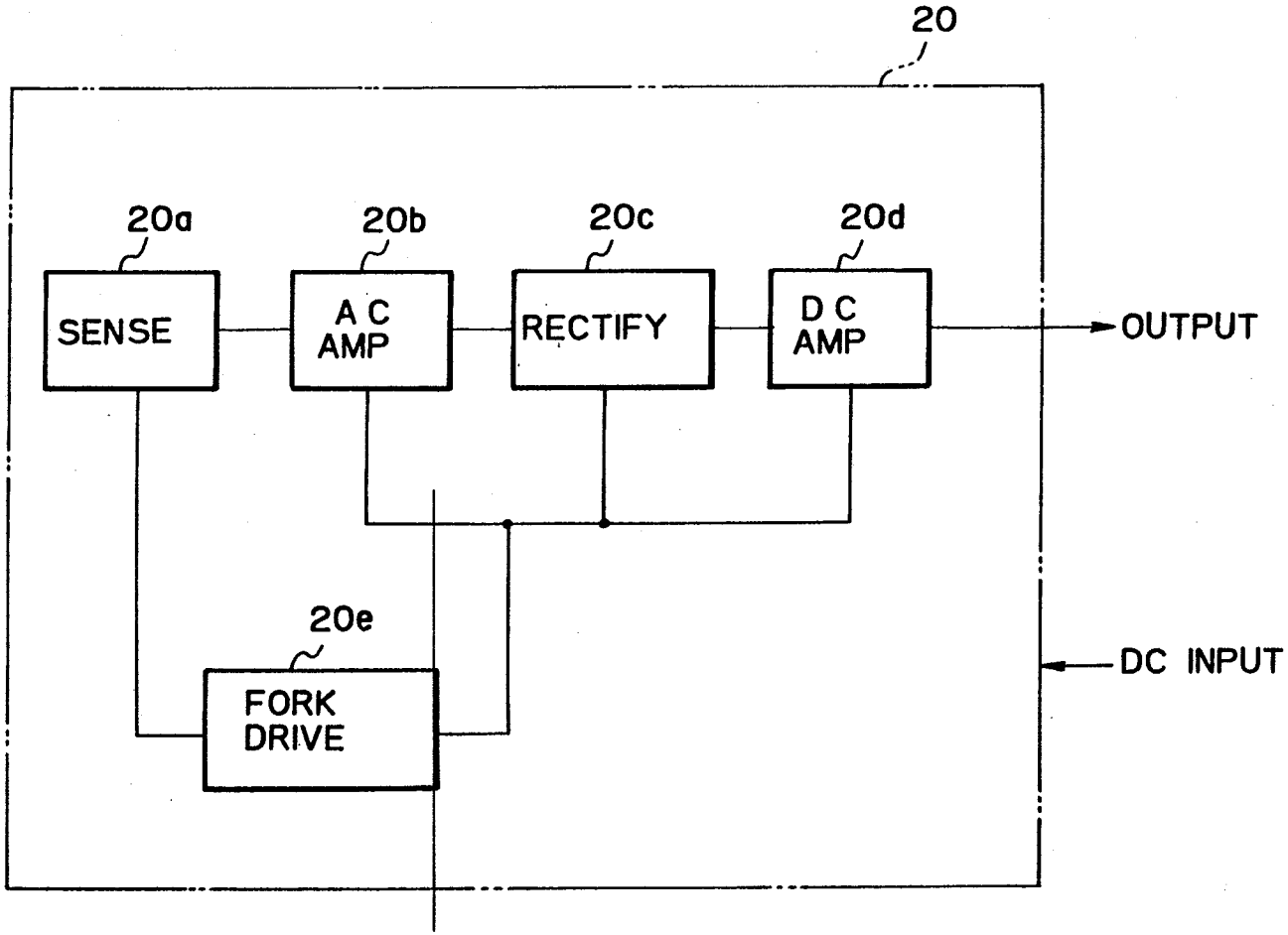
FIG. 4 is a block diagram showing a specific construction of a non-contact type potential sensor shown in FIG. 1.

FIG. 4 shows a specific construction of the potential sensor 20. As shown, the potential sensor 20 is made up of a sensing section 20*a*, an AC amplifying section 20*b*, a rectifying section 20*c*, a DC amplifying section 20*d*, and a fork driving section 20*e*. The fork driving section 20*e* drives a tuning fork which is included in the sensing section 20*a*. As the fork is caused to oscillate by the fork driving section 20*e*, the sensing section 20*a* outputs an AC sensed potential. The AC sensed potential is routed through the AC amplifying section 20*b*, rectifying section 20*c* and DC amplifying section 20*d* to become a DC voltage.

Figures 1, 2, 5A:
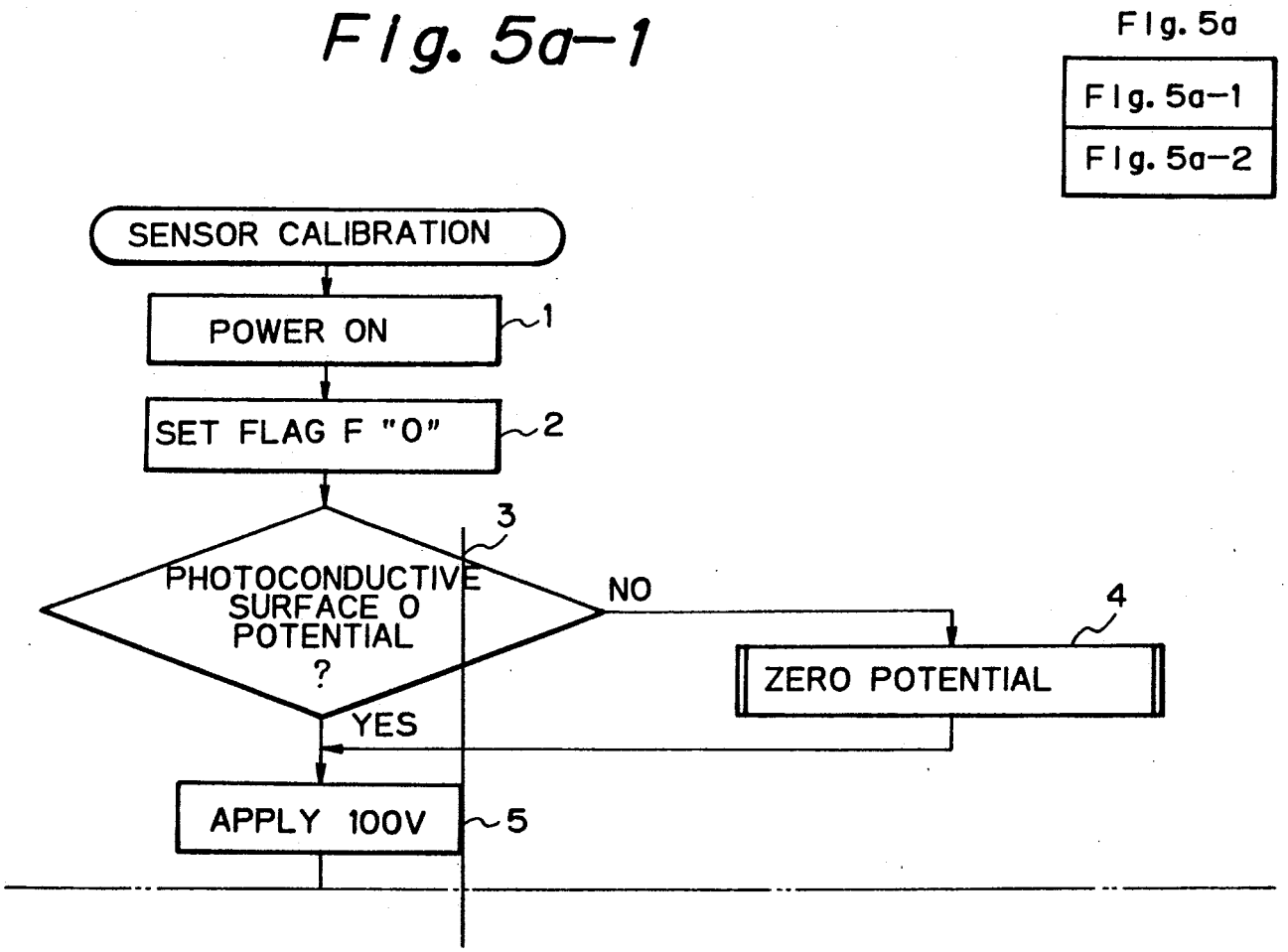
FIGS. 5*a* and 5*b* are flowcharts demonstrating specific operations of a CPU included in the circuitry of FIG. 2.
Figures 2, 5A:
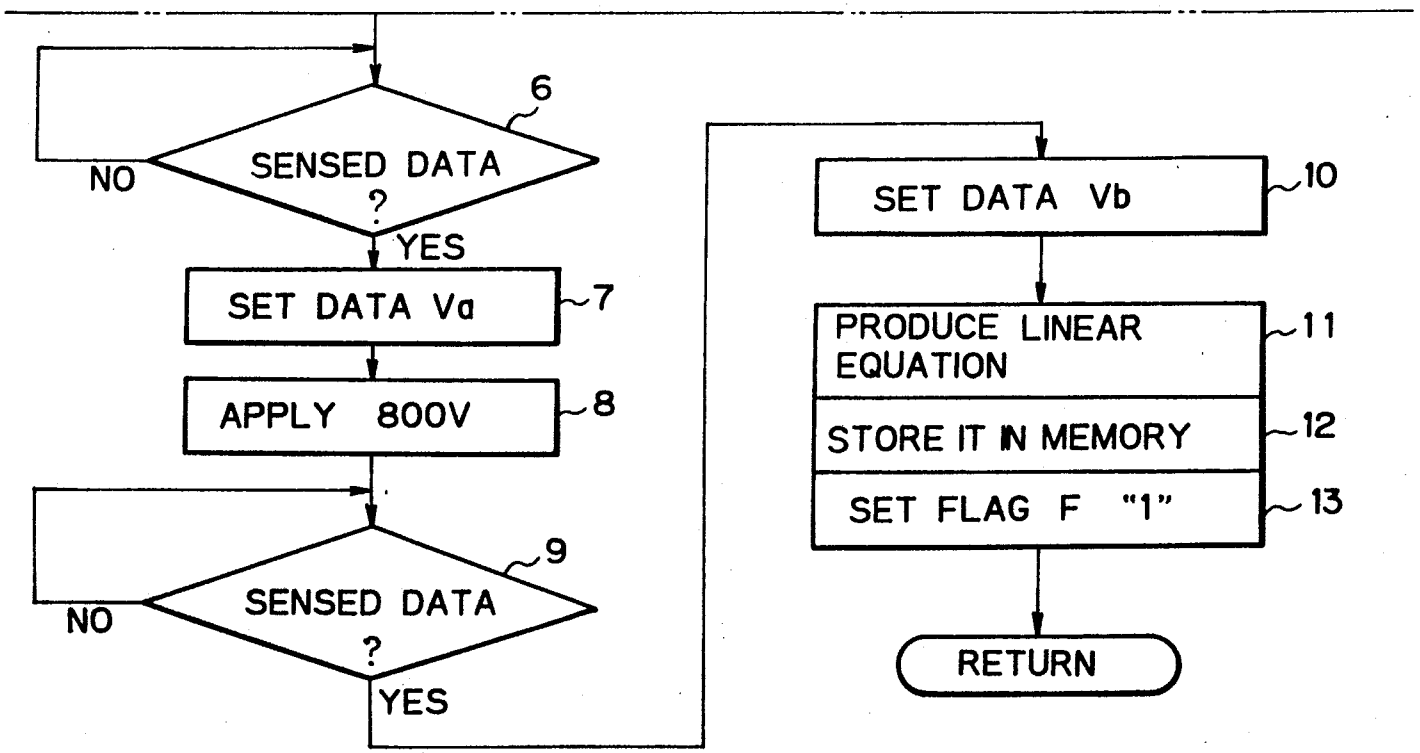

A reference will be made to FIGS. 5*a* and 5*b* for describing specific operations of the CPU 40. Specifically, FIG. 5*a* shows a procedure for determining a linear equation representative of the reference input-output characteristic of the potential sensor ("SENSOR CALCULATION"). In this procedure, when the power source is turned on (step 1), the CPU 40 clears a flag F which will be described (step 2). Then, the CPU 40 determines whether or not the photoconductive layer constituting the surface of the photoconductive element 4 is held at zero potential (step 3). If the answer of the step 3 is NO, the CPU 40 sets up zero potential on the photoconductive layer by a "ZERO POTENTIAL PROCESSING" subroutine such as illumination (step 4). In the illustrative embodiment, the photoconductive element 4 is implemented by a support in the form of a drum of aluminum, and a photoconductive layer of selenium deposited on the mirror-finished surface of the support. In this configuration, when the potential of the photoconductive layer is zero relative to the aluminum support, the surface potential of the photoconductive layer is the same as the potential of the aluminum support. At this instant, the prerequisite is that the aluminum support be in a potentially floating state relative to the casing of the copier. Hence, when a voltage is applied to the aluminum support, the potential of the support is the same as the applied voltage.

Figure 6:
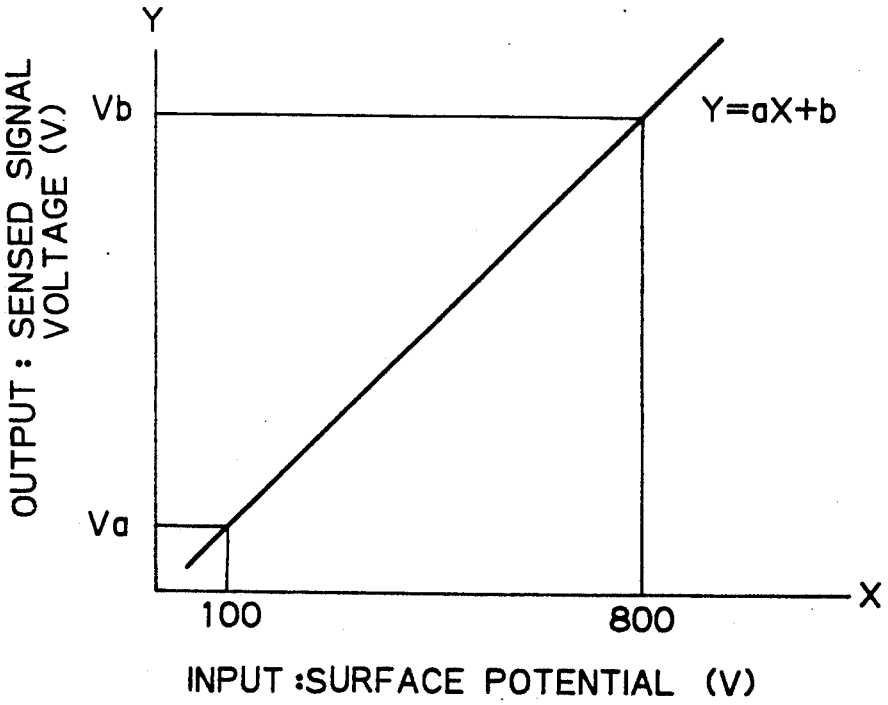
FIG. 6 is a graph representative of the input-output characteristic of the potential sensor shown in FIG. 1.

Subsequently, as shown in FIG. 6, the CPU 40 applies 100 volts to the aluminum support of the photoconductive element 4 (step 5). Then, the CPU 40 reads a value corresponding to the resulted output of the potential sensor 20 and determines it to be a sensed signal voltage Va (steps 6 and 7). In the embodiment, the voltage of 100 volts is applied from the high-tension bias source 60 via a relay. Thereafter, the CPU 40 applies 800 volts from the bias source 60 to the aluminum support (step 8) and determines a value corresponding to the resulted output of the sensor 20 as another sensed signal voltage Vb (steps 9 and 10). Based on the fact that the input-output characteristic of the potential sensor 20 is linear, the CPU 40 produces the following linear equation (values of a and b) from the two points having been determined in the steps 5-10:

$$Y=aX+b \qquad \text{Eq. (1).}$$

The CPU 40 writes such a linear equation in a memory, not shown, (steps 11 and 12). Subsequently, the CPU 40 sets the previously mentioned flag F showing that the linear equation, or reference, has been set up (step 13).

As stated above, the illustrative embodiment sets up a linear equation or reference representative of the input-output characteristic of the potential sensor 20 machine by machine. Therefore, even when the actual distance or gap d between the sensor 20 and the photoconductive element 4 is deviated from the designed gap, surface potentials can be accurately calculated on the basis of the linear equation.

While the embodiment performs calculation with the linear equation, i.e., values a and b every time the power source is turned on, the calculation may be effected periodically to store the resulted coefficients a and b in a non-volatile memory.

Figure 5B:
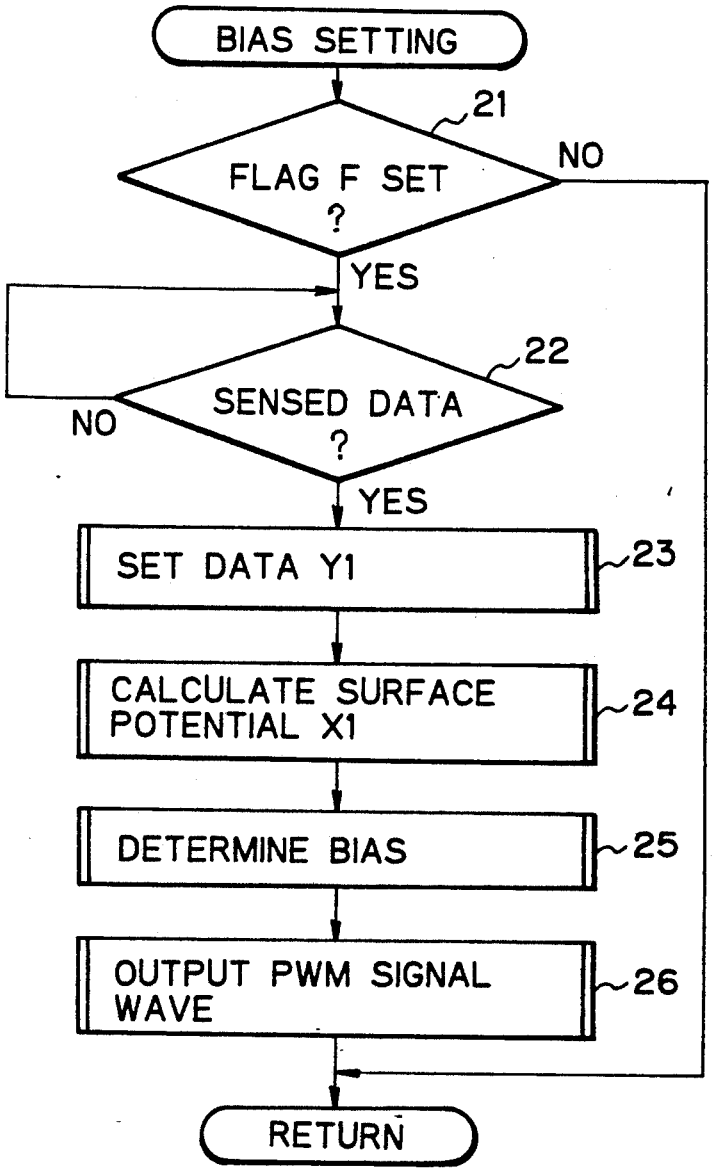

Referring to FIG. 5*b*, there is shown a "BIAS SETTING" procedure which the CPU 40 executes for controlling the bias voltage in response to the output of the potential sensor 20. First, the CPU 40 checks the flag F to see if the linear equation, FIG. 5*a*, has been set (step 21). If the answer of the step 21 is NO, the CPU 40 does not execute the subsequent steps since it is quite likely that the potential to be sensed by the sensor 20 is not the accurate surface potential of the photoconductive element 4. If the flag F has been set as determined in the step 21, the CPU 40 determines whether or not the sensor 20 has sensed the surface potential of the photoconductive element 4 (step 22). If the answer of the step 22 is YES, the CPU 40 reads a value corresponding to the potential data and determines it to be a value $Y_1$ (step 23). The CPU 40 substitutes the value $Y_1$ for Y included in the Eq. (1) to thereby determine the surface potential $X_1$ of the photoconductive element 4. Then, the CPU 40 determines a bias voltage matching the surface potential and causes the PWM generator 50 to generate the PWM signal waveform, FIG. 3, which matches the determined bias voltage (steps 25 and 26).

In summary, in accordance with the present invention, a linear equation representative of the input-output characteristic of a potential sensor is produced as a reference, and a surface potential accurately corresponding to the output of the potential sensor is calculated by use of the linear equation. The bias voltage for development or similar image forming parameter is controlled in matching relation to the calculated surface potential. This is successful in freeing surface potential data from the influence of the irregularity in the distance between the sensor and a photoconductive element. Hence, accurate image forming conditions are achievable without resorting to a reference potential area otherwise provided on the surface of the photoconductive element. It is not necessary, therefore, to use an expensive potential sensor.

Various modifications will become possible for those skilled in the art after receiving the teachings of the present disclosure without departing from the scope thereof.

What is claimed is:

1. An image forming apparatus for uniformly charging the surface of a photoconductive element, comprising:

voltage applying means for applying first and second predetermined voltages to the photoconductive element;

surface potential sensing means for sensing first and second surface potentials on said photoconductive element based on said respective first and second applied voltages;

calculating means for calculating a linear equation representing a reference input-output characteristic of said surface potential sensing means based on said sensed first and second surface potentials; and control means for controlling an image forming condition of said image forming means based on the calculated linear equation.

2. The image forming apparatus according to claim 1, further comprising a storage means for storing said linear equation.

3. The image forming apparatus according to claim 1, wherein said control means comprises a CPU.

4. The image forming apparatus according to claim 1, wherein said first predetermined voltage is lower than said second predetermined voltage.

5. A method for uniformly charging a surface of a photoconductive element of an image forming apparatus, comprising the steps of:

applying a first predetermined voltage to the photoconductive element;

sensing a first surface potential of said photoconductive element by a surface potential sensing means based on said first applied voltage;

applying a second predetermined voltage to the photoconductive element;

sensing a second surface potential of said photoconductive element by the surface potential sensing means based on said second applied voltage;

calculating a linear equation representing a reference input-output characteristic of said surface potential sensing means based on said sensed first and second surface potentials; and controlling an image forming condition of said image forming apparatus based on the calculated linear equation.

6. The method according to claim 5, further comprising the step of:

storing the calculated linear equation in a memory.

7. The method according to claim 5, wherein said controlling step uses a CPU.

8. The method according to claim 5, wherein said first predetermined voltage is lower than said second predetermined voltage.

* * * * *